United States Patent [19]

Hayasaka

[11] Patent Number: 4,909,767

[45] Date of Patent: Mar. 20, 1990

[54] PROPULSION UNIT FOR INBOARD-OUTBOARD MOTOR

[75] Inventor: Kenichi Hayasaka, Hamamatsu, Japan

[73] Assignee: Sanshin Kogyo Kabushiki Kaisha, Shizuoka, Japan

[21] Appl. No.: 252,683

[22] Filed: Oct. 3, 1988

[30] Foreign Application Priority Data

Oct. 2, 1987 [JP] Japan ..... 62-249484

[51] Int. Cl.[4] ..... B63H 21/28

[52] U.S. Cl. ..... 440/75; 74/325; 74/378; 440/57

[58] Field of Search ..... 440/49, 53–65, 440/75, 79, 112; 74/325, 378, 417

[56] References Cited

U.S. PATENT DOCUMENTS

| | | | |
|---|---|---|---|
| 3,871,325 | 3/1975 | Raulerson | 440/57 |
| 3,888,203 | 6/1975 | Lohse | 440/112 |
| 4,318,702 | 3/1982 | Stacey | 440/75 |
| 4,650,428 | 3/1987 | Bland et al. | 440/64 |

*Primary Examiner*—Joseph F. Peters, Jr.
*Assistant Examiner*—Jesûs D. Sotelo
*Attorney, Agent, or Firm*—Ernest A. Beutler

[57] ABSTRACT

A marine outboard drive that is particularly adapted for use in twin stern drive arrangements and which facilitates selective reversal of the degree of rotation of the output shaft. This is accomplished by means of a bevel gear train including a bevel gear that is selectively positionable upon the input shaft so as to drive the drive shaft in either of two selective directions of rotation. The bearing and dog clutching arrangement of the system is such that loads can be taken regardless of the direction of rotation.

9 Claims, 4 Drawing Sheets

PROPULSION UNIT FOR INBOARD-OUTBOARD MOTOR

BACKGROUND OF THE INVENTION

This invention relates to a propulsion unit for an inboard-outboard motor and more particularly to an improved propulsion unit that lends itself to reversal of the rotation of the propulsion device in a simple and expedient manner for twin outboard drive arrangements.

It is well known that a marine outboard drive generally has a side thrust due to the direction of rotation of either the propeller or other propulsion device. This side thrust may be countered by employing twin counterrotating outboard drives. For this and a variety of other reasons, it has been increasing practice to use such twin outboard drives, be they outboard motors or the outboard drive unit of an inboard-outboard arrangement.

In connection with such twin outboard drives, normally there is a separate internal combustion engine that powers each outboard driven. In order to achieve the counterrotation of the outboard drives, either the internal combustion engines must rotate in opposite directions or the gearing associated in the drive between the engine and the propulsion device must include a reversing mechanism for reversing the direction of rotation. In addition, each outboard drive normally includes its own forward, neutral, reverse transmission so as to permit propulsion of the watercraft in either forward or reverse directions.

Because of the fact that the outboard drives, either outboard motors or inboard-outboard drives, may be used either singly or in pairs, it is very desirable if the same basic construction can be utilized for both single and twin installations. This presents problems in connection with twin installations since, as aforenoted, the drives should rotate in opposite directions in such applications.

It is, therefore, a principal object of this invention to provide an improved and simplified arrangement for permitting reverse rotation of a marine outboard drive.

It is further object of this invention to provide a marine outboard drive that lends itself to ease in reversing the direction of rotation without necessitating major changes to the overall construction.

In conjunction with most conventional outboard drives, they are designed so that the input shaft rotates in a constant direction and the driving thrust on the unit always apply in the same direction. However, when the drive is designed so as to be driven in reverse directions for facilitating application with twin drives, the previously proposed constructions have not been completely satisfactory.

It is, therefore, a still further object of this invention to provide a marine outboard drive which can easily be rotated in either of two selected directions and wherein the mechanism is designed so as to take loadings regardless of the direction of drive.

SUMMARY OF THE INVENTION

This invention is adapted to be embodied in a marine outboard drive that is comprised of a first shaft driven by an engine and rotating in a fixed direction. A second shaft is rotatable about an axis that is non-parallel with the first shaft. A propulsion unit is driven from the second shaft through a forward, neutral, reverse transmission for driving the propulsion unit in selected forward or reverse directions. In accordance with the invention, reversible means are provided for driving the second shaft from the first shaft in selected forward or reverse directions.

DETAILED DESCRIPTION OF THE PREFERRED EMBODIMENT

Figure 1:
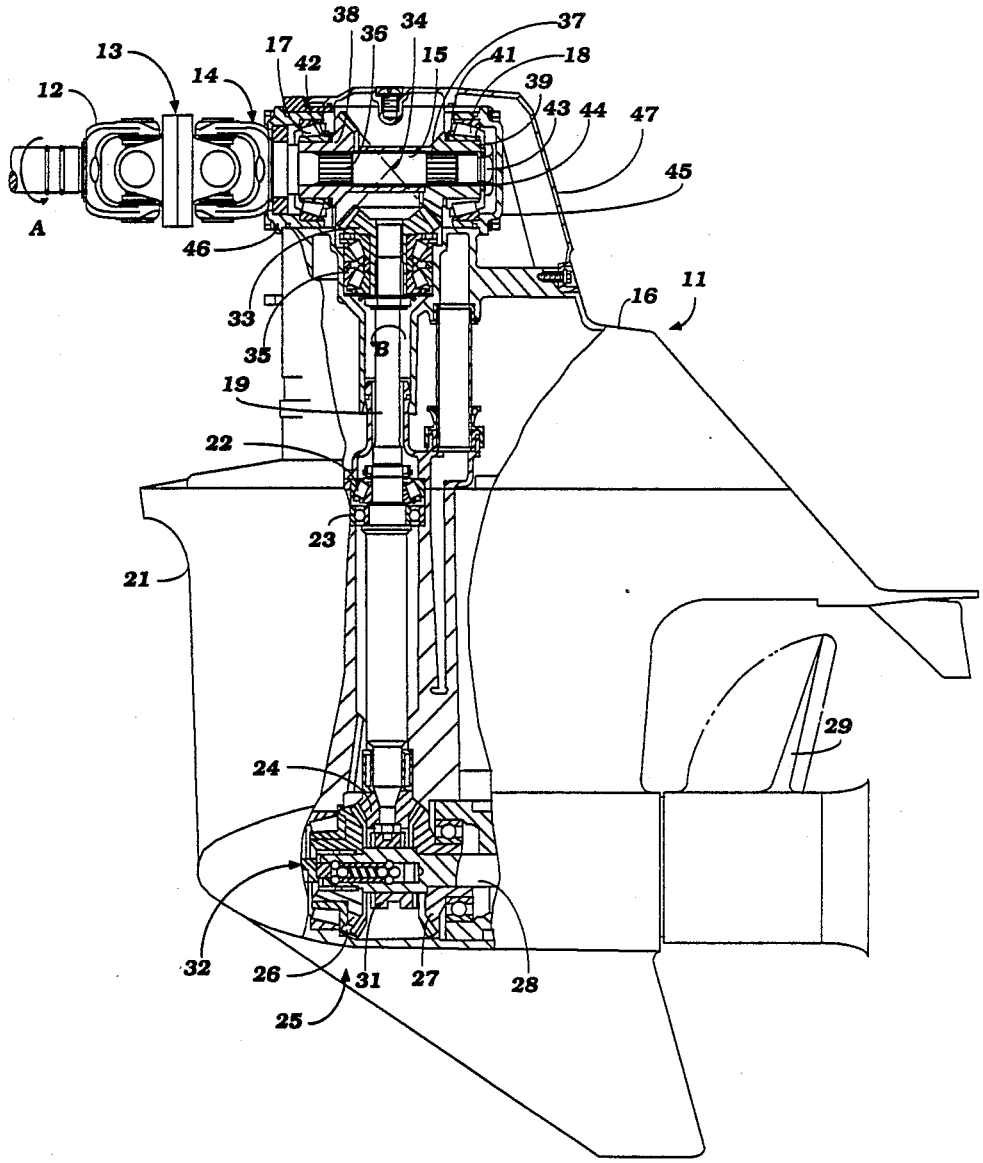
FIG. 1 is a side elevational view, with portions shown in section, of a marine outboard drive constructed in accordance with an embodiment of the invention and set up for rotation in a first direction.
Figure 2:
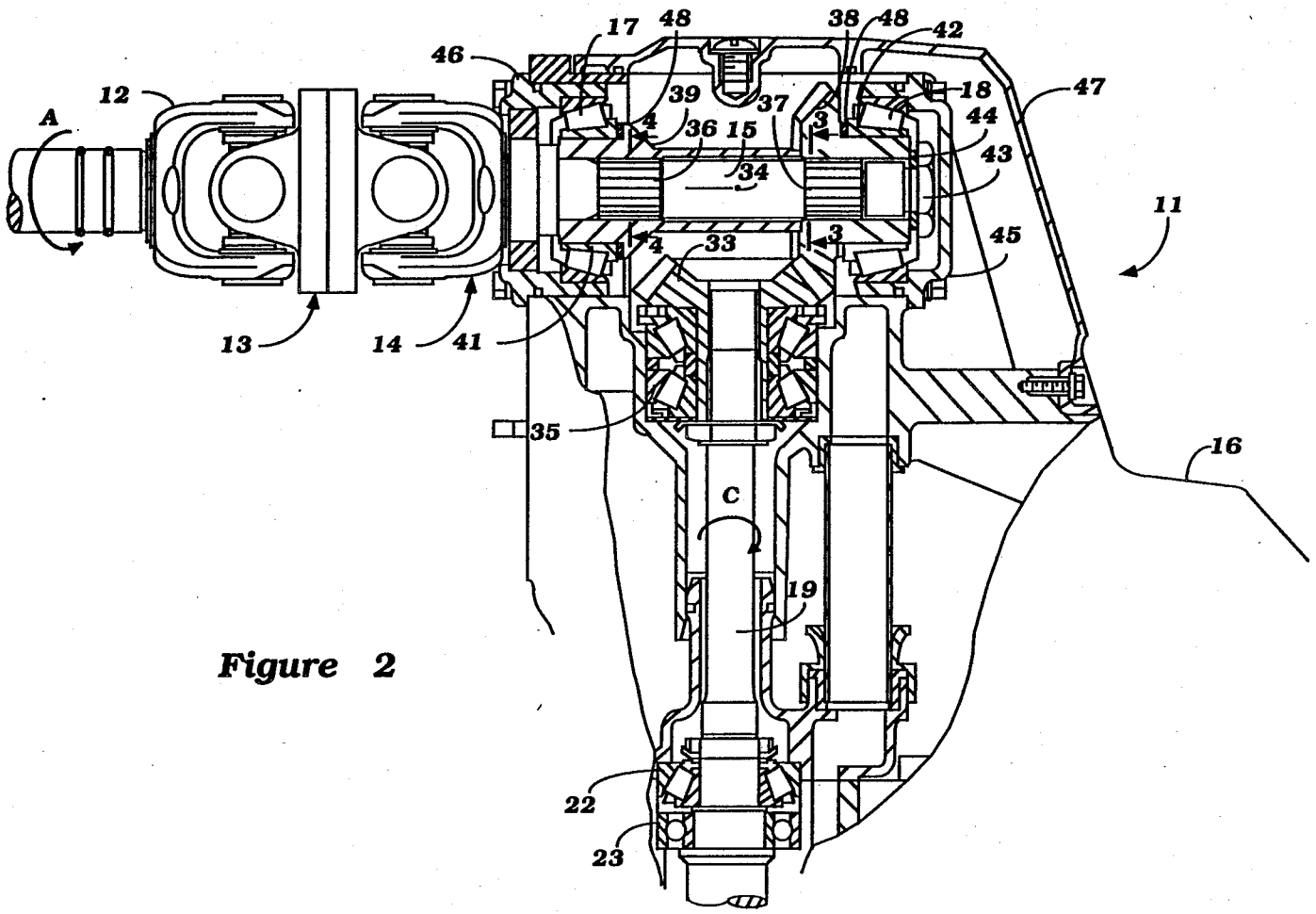
FIG. 2 is an enlarged view showing a portion of the construction illustrated in FIG. 1 and set up for counterrotation.

Referring first primarily to FIGS. 1 and 2, a marine outboard drive constructed in accordance with an embodiment of the invention is identified generally by the reference numeral 11. In the illustrated embodiment, the outboard drive 11 is comprised of the outboard drive unit of an inboard-outboard drive. It is to be understood, however, that certain facets of the invention may be applied equally as well with outboard motors. The invention, however, has particular utility in connection with arrangements where it is desirable to have the outboard drive and specifically its propulsion unit rotate in either normal or counterrotation modes.

The outboard drive 11 is powered by a remotely positioned internal combustion engine (not shown) which drives an input shaft 12 that rotates in a constant direction, indicated generally by the arrow A and which is, in the illustrated construction, counterclockwise. The drive shaft 12 is coupled by means of a universal joint 13 to an input shaft 14 of the outboard drive 11. The input shaft 14 has an extending portion 15 that is journaled within an outer housing 16 of the outboard drive 11 by means of a pair of spaced apart thrust bearings 17 and 18, in a manner to be described.

A vertically extending drive shaft 19 is supported in the housing 16 by means of bearings to be described and depends into a lower unit 21. The drive shaft 19 is driven from the input shaft 15, in a manner to be described, so as to rotate either in a forward direction indicated by the arrow B in FIG. 1 or a reverse or counterdirection indicated by the arrow C in FIG. 2.

The drive shaft 19 is journaled by means of a first thrust bearing 22 that is positioned between the drive shaft housing 16 and lower unit housing 21 and an anti-friction bearing 23 which is journaled adjacent it. The thrust bearing 22 is designed to take vertically upward thrusts transmitted to the drive shaft 19.

At its lower end, a bevel gear 24 is affixed for rotation with the drive shaft 19 in a known manner. The bevel gear 24 forms a portion of a forward, neutral, reverse transmission, indicated generally by the reference numeral 25. The forward, neutral, reverse transmission 25 includes a pair of counterrotating bevel gears comprised of a forward drive gear 26 and a reverse drive gear 27 that are in mesh with the driving bevel gear 24 on diametrically opposite sides of it. The bevel gears 26 and 27 are journaled upon a propeller shaft 28 to which a propulsion device such as a propeller 29 is affixed in a known manner.

A dog clutching sleeve 31 has a splined connection with the propeller shaft 28 so as to rotate with it and also to be axially movable along it. A shifting mechanism, shown partially at 32, is provided for shifting the dog clutching sleeve 31 between a neutral position as shown in FIG. 1 and a forward position wherein the dog clutching sleeve 31 rotatably couples the forward bevel gear 26 with the propeller shaft 28. Alternatively, the shifting mechanism 32 may shift the dog clutching sleeve 31 rearwardly so as to engage with the reverse gear 27 so as to rotatably couple this gear with the propeller shaft 28 for driving the propeller 29 in a reverse direction. This mechanism is generally conventional and, for that treason, further description of it is not believed to be necessary to understand the construction and operation of the invention features of this embodiment.

It will be noted that a bevel gear 33 is affixed to the upper end of the drive shaft 19. The bevel gear 33 has its pitch circle arranged so that it intersects a point 34 at which the input shaft 15 is intersected by the axis of rotation of the drive shaft 19. The upper end of the drive shaft 19 and specifically the driven bevel gear 33 is supported by means of a double taper bearing 35 so as to take driving thrusts on the bevel gear 33 in opposite directions. This is in contradistinction to conventional constructions wherein a single acting thrust bearing is normally employed in this area. However, in accordance with the embodiment of the invention, the drive shaft 19 is adapted to be rotated in either the forward B or reverse C directions by the mechanism now to be described. As a result, the thrust bearing 35 is designed to take thrusts in either direction.

It will be noted noted that the input shaft portion 15 is provided with spaced splined sections 36 and 37 that are spaced equidistant from the point of intersection 34 of the input shaft 14 and the drive shaft 19. A driving bevel gear 38 is designed to be selectively engaged with either the splined section 36 (FIG. 1) forward rotation in the direction of the arrow B or with the splined section 37 (FIG. 2) for counterrotation in the direction of the arrow C. A spacer sleeve 39 cooperates with the bevel gear 38 so as to insure proper alignment in each condition. It should be noted that the spacer sleeve 39 is formed with a hub portion 41 which is complementary in configuration to a hub portion 42 of the bevel gear 38 so as to facilitate this reversing in the direction of rotation.

In the forward degree of rotation as shown in FIG. 1, the hub 42 of the driving bevel gear 38 is journaled in the thrust bearing 17 and the hub 41 of the spacer shaft 39 is journaled in the thrust bearing 18. The assemblage is held together by means of a lock nut 43 and lock washer 44 that are received on a threaded end of the input shaft 14. A bearing cap 45 serves to hold and locate the thrust bearing 18. At the opposite end, a bearing cap 46 holds and locates the thrust bearing 17. A removable cover plate 47 affords access to the nut 43 so as to facilitate reversal of the bevel gear 38 and spacer sleeve 39 on the input shaft section 16 for reversal of the direction of rotation. Shims 48 are interposed between the thrust bearings 17 and 18 and the gear 38 and spacer sleeve 39 so as to provide axial alignment between the bevel gears 38 and 33.

Figure 4:
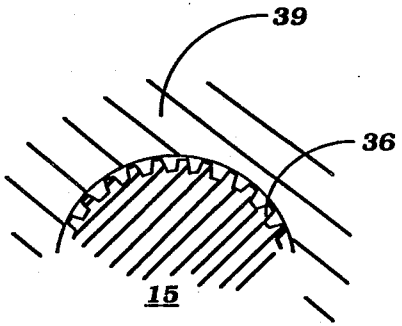
FIG. 4 is an enlarged cross-sectional view taken along the line 4—4 of FIG. 2.
Figure 3:
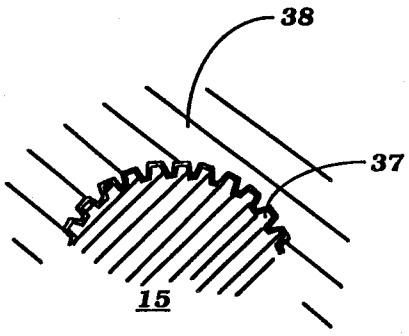
FIG. 3 is an enlarged cross-sectional view taken along the line 3—3 of FIG. 2.

It should be readily apparent, therefore, that a very simple and highly effective arrangement is incorporated which permits reversal in the direction of rotation of the drive shaft 19 without necessitating reversal of the rotation of the engine output shaft 12. It will be noted from FIG. 4 that the spacing sleeve 39 does not have any splined internal surface but merely has a bore that will clear the splines 36 or 37. If desired, however, there could be incorporated a splined connection between the spacer sleeve and the splines 36 and 37 of the input shaft portion 15.

Figure 5:
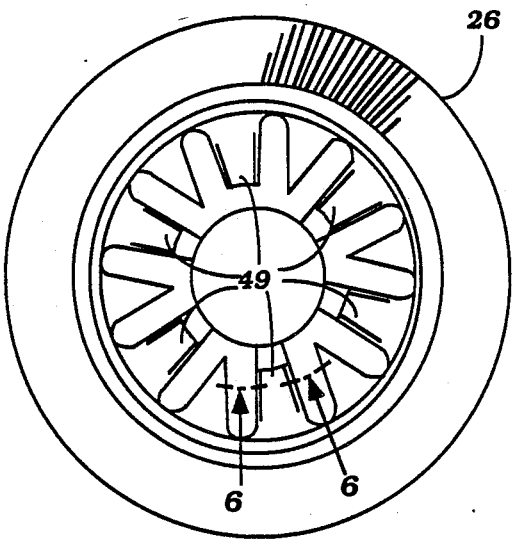
FIG. 5 is an enlarged front elevational view of one of the gears of the forward, reverse transmission of the lower unit.
Figure 6:
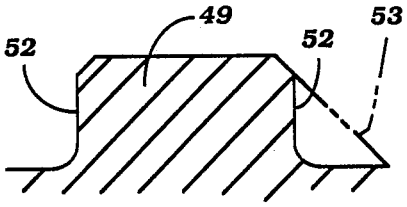
FIG. 6 is a cross-sectional view taken along the line 6—6 of FIG. 5 and shows a comparison between the construction in accordance with the invention and the prior art, the latter being shown in phantom.
Figure 7:
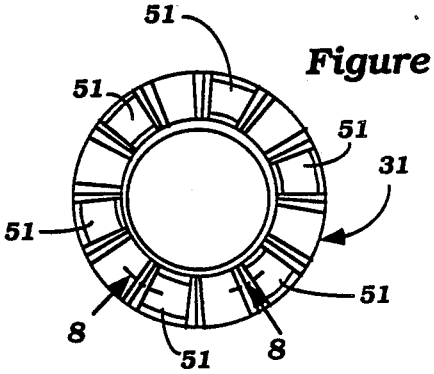
FIG. 7 is an enlarged end elevational view of the face of the dog clutching element that mates with the driven gear shown in FIGS. 5 and 6.
Figure 8:
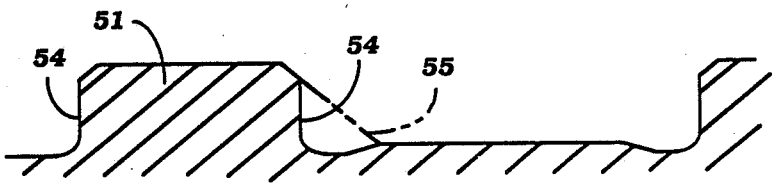
FIG. 8 is an enlarged cross-sectional view taken along the line 8—8 of FIG. 7 showing the comparison between the construction in accordance with the invention, as shown in solid lines and the prior art as shown in phantom lines.

In addition to including the double acting thrust bearing 36, the dog clutching teeth of the forward, neutral, reverse transmission 25 are designed so as to accommodate the opposite directions of rotation of the drive shaft 16. As seen in FIG. 5, the bevel gear 26 has dog clutching teeth 49 which face the bevel gear 27. Corresponding dog clutching teeth are formed on the driven gear 27. Also, the dog clutching sleeve 31 (FIGS. 7 and 8) has dog clutching teeth 51 at its opposite sides which face the respective dog clutching teeth of the gears 26 and 27. Normally, the dog clutching teeth 49 and 51 are asymmetric in cross sections (FIGS. 6 and 7). That is, the dog clutching teeth 49 have a first driving face 52 and an inclined non-driving face 53. In a like manner, the dog clutching teeth 51 have a driving face 54 and a non-driving face 55. In accordance with the invention, however, both faces of the teeth 49 and 51 are configured as at 52 and 54 so as to accommodate drive in opposite direction.

It should be readily apparent from the foregoing description that a highly effective and very simple arrangement has been provided wherein a marine outboard drive can be accommodated so as to rotate in either forward or counterdirections through a very simple rearrangement of the gears which drive the propeller shaft. In addition, the construction is such that reverse thrusts can be taken regardless of the direction of rotation and the dog clutching mechanism is fully reversible. Although a specific embodiment of the invention in achieving these results has been illustrated and described, various changes and modifications may be made without departing from the spirit and scope of the invention, as defined by the appended claims.

I claim:

1. A marine outboard drive comprising a first shaft driven by an engine and rotatable in a first direction, said first shaft having axially spaced apart splined portions, a second shaft rotatable about an axis non-parallel with said first shaft and which axis intersects said first shaft between said splined portions, a propulsion unit, a forward-reverse transmission for driving said propulsion unit form said second shaft in selected forward and reverse directions, and reversible means for driving said second shaft from said first shaft in selected forward or reverse directions comprising a first bevel gear having a splined portion engagable with a selected one of said first shaft splined portions for selective rotation therewith, a sleeve engagable at one end with said first bevel gear and adapted to encircle the splined portion of said first shaft not engaged with said first gear for axially positioning said first gear on said first shaft and a second bevel fixed to said second shaft engaged with said first gear and rotatable in a direction dictated by which of said first shaft splined portions said first gear is engaged with.

2. A marine outboard drive as set forth in claim 1 further including oppositely acting thrust bearing means for supporting said second shaft and taking thrusts in opposite directions exerted thereon.

3. A marine outboard drive as set forth in claim 2 wherein the oppositely acting thrust bearings support the second bevel gear.

4. A marine outboard drive as set forth in claim 1 wherein the forward-reverse transmission includes a driving bevel gear affixed to the second shaft and oppositely rotating driven bevel gears associated with the propulsion unit and dog clutching means for selectively clutching said driven bevel gears to said propulsion unit.

5. A marine outboard drive as set forth in claim 4 wherein the dog clutching means are symmetric for transferring driving thrusts in either direction of rotation.

6. A marine outboard drive as set forth in claim 5 further including oppositely acting thrust bearing means for supporting said second shaft and taking thrust in opposite directions exerted thereon.

7. A marine outboard drive as set forth in claim 6 wherein the oppositely acting thrust bearings support the second bevel gear.

8. A marine outboard drive as set forth in claim 1 further including spaced apart thrust bearings encircling the first shaft, the first bevel gear having a hub portion adapted to be affixed within one of said thrust bearings for supporting said first gear and said first shaft, said sleeve having a hub portion adapted to be engaged in and supported by the other of said thrust bearings for supporting said sleeve and said first shaft, the spacing between said thrust bearings determining the axial positioning of said first bevel gear and said sleeve on said first shaft.

9. A marine outboard drive as set forth in claim 8 wherein the thrust bearings are carried by readily removable bearing caps supported in an outer housing of the outboard drive for ready reversal of the position of the first bevel gear on the first shaft.

* * * * *